US008846999B2

(12) United States Patent
Ledoux et al.

(10) Patent No.: US 8,846,999 B2
(45) **Date of Patent: *Sep. 30, 2014**

(54) METHOD FOR TREATING A NITRIC AQUEOUS LIQUID EFFLUENT BY CALCINATION AND VITRIFICATION

(75) Inventors: Alain Ledoux, Bagnols sur Ceze (FR); Jean-François Hollebecque, Villeneuve les Avignon (FR)

(73) Assignee: Areva NC, Paris (FR)

( * ) Notice: Subject to any disclaimer, the term of this patent is extended or adjusted under 35 U.S.C. 154(b) by 132 days.

This patent is subject to a terminal disclaimer.

(21) Appl. No.: 13/142,243

(22) PCT Filed: Dec. 23, 2009

(86) PCT No.: PCT/EP2009/067900

§ 371 (c)(1),
(2), (4) Date: Aug. 30, 2011

(87) PCT Pub. No.: WO2010/076287

PCT Pub. Date: Jul. 8, 2010

(65) Prior Publication Data

US 2012/0016173 A1 Jan. 19, 2012

(30) Foreign Application Priority Data

Dec. 30, 2008 (FR) ..... 08 59138

(51) Int. Cl.
*G21F 9/14* (2006.01)
*G21F 9/30* (2006.01)

(52) U.S. Cl.
CPC . *G21F 9/305* (2013.01); *G21F 9/14* (2013.01)
USPC ..... 588/19

(58) Field of Classification Search
USPC ..... 588/19, 2, 11, 18
See application file for complete search history.

(56) References Cited

U.S. PATENT DOCUMENTS

| | | | |
|---|---|---|---|
| 3,008,904 A | 11/1961 | Johnson, Jr. et al. | |
| 3,272,756 A | 9/1966 | Kaser | |
| 4,009,990 A | 3/1977 | Bonniaud et al. | |
| 4,514,329 A | 4/1985 | Wakabayashi et al. | |

FOREIGN PATENT DOCUMENTS

| | | | |
|---|---|---|---|
| CA | 1044015 | 12/1978 | |
| FR | 2299705 | 8/1976 | |
| GB | 1492464 | 11/1977 | |
| GB | 2025685 | 1/1980 | |
| JP | 53109100 A * | 9/1978 | ..... G21F 9/30 |

OTHER PUBLICATIONS

International Search Report and Written Opinion in International Application No. PCT/EP2009/067900, mailed Jul. 8, 2010.
French Search Report in French Patent Application No. FR 0859138, dated Oct. 1, 2009.
International Preliminary Report on Patentability in International Application No. PCT/EP2009/067900, dated Apr. 8, 2011.

* cited by examiner

*Primary Examiner* — John Kreck
(74) *Attorney, Agent, or Firm* — Nixon Peabody LLP

(57) ABSTRACT

A method for treating a nitric aqueous liquid effluent containing nitrates of metals or metalloids, comprising a step for calcination of the effluent in order to convert the nitrates of metals or metalloids into oxides of said metals or metalloids, at least one compound selected from the nitrates of metals or metalloids and the other compounds of the effluent leading upon calcination to a tacky oxide, and a dilution adjuvant comprising at least one nitrate of metal or metalloid leading upon calcination to a non-tacky oxide being added to the effluent prior to the calcination step in order to give a mixture of effluent and of dilution adjuvant.

10 Claims, No Drawings

METHOD FOR TREATING A NITRIC AQUEOUS LIQUID EFFLUENT BY CALCINATION AND VITRIFICATION

CROSS REFERENCE TO RELATED APPLICATIONS OR PRIORITY CLAIM

This application is a National Phase of PCT/EP2009/067900, filed Dec. 23, 2009, entitled, "METHOD FOR PROCESSING A NITROUS AQUEOUS LIQUID EFFLUENT BY CALCINATION AND VITRIFICATION", and which claims priority of, French Patent Application No. 08 59138, filed Dec. 30, 2008, the contents of which are incorporated herein by reference in their entirety.

The invention relates to a method for treating a nitric aqueous liquid effluent containing nitrates of metals or metalloids, which comprises a calcination step generally followed by a step for vitrification of the calcinate obtained during said calcination step.

The nitric aqueous liquid effluent may contain in majority sodium nitrate.

The technical field of the invention may generally be defined as that of the calcination of liquid effluents, more particularly the technical field of the invention may be defined as that of the calcination of radioactive liquid effluents with view to their vitrification.

The French method for vitrification of radioactive liquid effluents includes two steps. The first step is a step for calcination of the effluent during which occurs drying and then denitration of a portion of nitrates, the second step is a vitrification step by dissolution in a confinement glass of the calcinate produced during the calcination step.

The calcination step is generally carried out in a rotating tube heated by an electric oven. The solid calcinate is milled by a loose bar placed inside the rotating tube.

During the calcination of certain solutions, in particular solutions rich in sodium nitrate, in other words, solutions with a high sodium content in a nitric medium, adhesion of the calcinate on the walls of the rotating tube may be observed which may lead to total clogging of the tube of the calciner.

The answer consisted of adding to the effluent a compound supposed to be non-tacky designated as a dilution adjuvant such as aluminium nitrate, in order to allow their calcination while avoiding clogging of the calciner.

But, the amount of calcination adjuvant for example aluminium nitrate, to be added is difficult to optimize. Thus for each new effluent, several tests are required in order to determine the operating calcination conditions in a heated rotating tube giving the possibility of avoiding cloggings of the tube. Especially, the heating of the calcination oven and the amounts of calcination adjuvant which is different from the dilution adjuvant, and which generally is sugar, have to be adjusted.

Further, in the case of aluminium nitrate, its addition to the effluent increases the amount of glass to be produced. Indeed, the presence of alumina in the glass increases its elaboration temperature and leads to limiting the waste, effluent load level in the glass, so as not to degrade the confinement, containment properties of this glass.

The aluminium content in the glass should therefore not be too high and is generally limited to about 15% by mass expressed as $Al_2O_3$.

Therefore considering the foregoing, there exists a need for a method for treating by calcination a nitric aqueous effluent containing compounds such as nitrates of metals or metalloids and other compounds, capable of forming tacky oxides during their calcination, wherein the operating conditions with which adhesion of the calcinate on the walls of the calcination tube may be avoided, may be simply determined by a limited number of calcination tests.

More specifically, there exists a need for such a method in which the amount of dilution adjuvant to be added to the effluent prior to the calcination, may be determined in a simple, reliable way by a reduced number of tests, thereby allowing optimization and reduction to a minimum of the amount of dilution adjuvant to be added to the effluent.

This method for treating a nitric aqueous effluent by calcination should of course be able to be applied in a reliable, reproducible way, regardless of the effluent treated and the dilution adjuvant which is applied.

Additionally, it would also be desirable that this method further limit the increase in the amount of confinement, containment glass to be produced during the vitrification of the calcinate.

The goal of the present invention is to provide a method for treating a nitric aqueous liquid effluent containing metal or metalloid nitrates, this method comprising a step for calcination of the effluent in order to convert the nitrates of metals and of metalloids into their oxides which i.e. meet the needs mentioned above.

The goal of the present invention is further to provide such a method which does not have the drawbacks, limitations, defects and disadvantages of the method for the prior art and which solves the problems of the methods of the prior art, especially as regards determination of the operating parameters of the method and optimization of the amount of dilution adjuvant to be added to the effluent.

This goal, and further other ones are achieved, according to the invention with a method for treating a nitric aqueous liquid effluent containing nitrates of metals or metalloids, comprising a step for calcination of the effluent in order to convert the nitrates of metals or metalloids into oxides of said metals or metalloids, at least one compound selected from the nitrates of the metals or metalloids and the other compounds of the effluent leading upon, during, calcination to a tacky oxide, and a dilution adjuvant comprising at least one nitrate of metal or metalloid leading upon, during, calcination to a non-tacky oxide being added to the effluent prior to the calcination step in order to give a mixture of effluent and of dilution adjuvant, in which the mixture meets the two following inequations (1) (2):

$$\frac{\text{mass of sodium nitrate of the mixture expressed in terms of oxide } Na_2O}{\text{mass of all the compounds of the mixture expressed in terms of oxides}} \leq 0.3 \quad (1)$$

$$\frac{\text{mass of all the compounds of the mixture leading upon their calcination to tacky oxides, expressed in terms of oxides}}{\text{mass of all the compounds of the mixture expressed in terms of oxides}} \leq 0.35. \quad (2)$$

In either one or both inequations (1) and (2), in the denominator, the mass of all the compounds of the mixture, expressed in terms of oxides, may optionally be simplified and replaced with the mass of all the salts of the mixture, including the nitrates, expressed in terms of oxides. The denominator may further possibly be simplified in both inequations (1) and (2) and replaced with the mass of the nitrates of the mixture, expressed in terms of oxides.

Further, in equation (2), in the numerator, the mass of all the compounds of a mixture leading upon their calcination to tacky oxides, expressed in terms of oxides, may possibly be simplified and replaced with the mass of nitrates and other compounds of the mixture leading upon their calcination to tacky oxides, expressed in terms of oxides, since the tacky compounds may generally comprise tacky nitrates and other tacky compounds or only other tacky compounds.

In inequation (2), the numerator may further be possibly simplified and replaced with the mass of the nitrates of the mixture leading upon, during, their calcination to tacky oxides, expressed in terms of oxides.

The most simplified form of both inequations (1) and (2) is therefore the following:

$$\frac{\text{mass of sodium nitrate of the mixture expressed in terms of oxide } Na_2O}{\text{mass of all the nitrates of the mixture expressed in terms of oxides}} \leq 0.3 \quad (1')$$

$$\frac{\text{mass of all the nitrates of the mixture leading upon calcination to tacky oxides, expressed in terms of oxides}}{\text{mass of all the nitrates of the mixture expressed in terms of oxides}} \leq 0.35 \quad (2')$$

Both of these inequations (1) (2) or (1') (2') are of general application, notably regardless of the dilution adjuvant.

The method according to the invention is fundamentally defined by the fact that the addition of the dilution adjuvant selected from the nitrates of metals or metalloids leading upon, during, their calcination to so-called non-tacky oxides, is governed by both inequations (1) (2) mentioned above. Surprisingly it was shown according to the invention that when the provision of dilution adjuvant was such that both inequations were verified, then the calcination of the effluent was possible without any adhesion occurring on the walls of the calcination apparatus, or any clogging of the latter.

Simple application of this very simple criterion for addition of the dilution adjuvant, based on the inequations above, reliably gives the possibility of avoiding, with certainty, clogging phenomena of the calciners.

With a single calcination test, and this regardless of the effluent, it is possible to optimize the characteristics of the calcinate especially as for its grain size, by simply acting on the heating and on the content of the calcination adjuvant which generally is sugar.

According to the invention, it was therefore possible to define a very simple mass criterion in order to determine the provision of dilution adjuvant, which a priori allows minimization, prior to calcination, of the amount of adjuvant to be added to the effluent in order to be able to avoid any clogging.

This simple reliable criterion is of general application regardless of the effluent treated generally containing in majority sodium nitrate and of the nature of the other tacky and non-tacky compounds which are contained therein. This criterion also applies regardless of the nature and of the number of the compounds, nitrates, added to the effluent as dilution adjuvants.

The dilution adjuvant comprises aluminium nitrate and optionally at least one other metal or metalloid nitrate, these nitrate(s) leading upon, during, calcination to at least one non-tacky oxide.

This at least one other metal or metalloid nitrate is generally selected from iron nitrate and rare earth nitrates.

The use of iron nitrate or a rare earth nitrate in a dilution adjuvant added to a nitric aqueous effluent prior to calcination of this effluent has never been mentioned or brought up until then.

Among the nitrates of the dilution adjuvant mentioned above, it was surprisingly found that iron nitrate and rare earth nitrates had properties for limiting the adhesion of the calcinate, close to those of aluminium nitrate, and that the oxides stemming from these specific nitrates, which are so-called "non-tacky" oxides, may also be dissolved in the final glass produced during the subsequent vitrification step.

The application, use, of a dilution adjuvant preferably comprising as a substitution for a portion of the aluminium nitrate, a nitrate selected from iron nitrate and rare earth nitrates gives the possibility of avoiding clogging of the tube of the calcination apparatus during, upon, calcination of effluents generating very tacky oxides, such as solutions with high sodium content, while minimizing the increase in the amount of confinement, containment glass to be produced during the vitrification step which generally follows calcination.

It may be stated surprisingly that iron nitrate and rare earth nitrates all have the excellent properties of aluminium nitrate as to its ability of limiting adhesion of the calcinate, and therefore of avoiding clogging of the calcination tube, while allowing the load level of the waste to be increased and therefore limiting the amount of glass to be produced.

The constraints, requirements, imposed on the glass-making formulation by the preferred dilution adjuvants according to the invention comprising a specific nitrate selected from iron nitrate and rare earth nitrates are significantly reduced with respect to the dilution adjuvants only consisting of aluminium nitrate because of the lower provision of aluminium.

Iron and rare earth nitrates therefore provide an additional advantage during the vitrification which will be added to the surprising effects and advantages due to the application according to the method of the invention, of the criteria (1) (2) defined above.

The rare earth nitrates are lanthanum nitrate, cerium nitrate, praseodymium nitrate, neodymium nitrate.

The dilution adjuvant may thus comprise aluminium nitrate and optionally at least one other nitrate selected from iron nitrate, lanthanum nitrate, cerium nitrate, praseodymium nitrate and neodymium nitrate.

The respective amount of each of the nitrates is free from the point of view of their efficiency for preventing adhesion of the calcinate in the tube and may therefore be adjusted depending on their impact on the properties of the confinement, containment, glass prepared in a subsequent vitrification step.

The amount of dilution adjuvant added to the liquid effluent is determined by applying both inequations (1) and (2).

The effluent is a nitric solution generally containing in majority sodium nitrate and other constituents such as nitrates (including the nitrates contained in the dilution adjuvant).

The effluent may also contain "tacky" or "non-tacky"compounds which are not nitrates, generally present as salts, such as phosphomolybdic acid which is a so-called "tacky" compound.

The method according to the invention allows calcination without clogging of all kinds of effluents, regardless of their nature, and of the nature of the nitrates and tacky nitrates which are found contained therein.

The liquid effluent treated by the method according to the invention contains at least one compound such as a metal or metalloid nitrate leading upon calcination to a so-called "tacky"oxide, and/or at least one other compound which is not such a nitrate leading upon calcination to a so-called "tacky-"oxide.

In the present description, the terms of "tacky compounds", "tacky oxides" or else "tacky nitrates" are used.

By "tacky compounds", "tacky nitrates", or "tacky oxides" are meant compounds, oxides, nitrates known to adhere to the walls of calcination apparatuses "calciners" and to induce phenomena clogging these calciners.

The terms of "tacky compound", "tacky oxide", "tacky nitrate" are terms currently used in this technical field, which have a well established meaning, which are known to the man skilled in the art and which do not have any ambiguity for him.

Thus, the compound(s) such as the nitrate(s) and/or the other compound(s) which lead(s) upon calcination to tacky oxide(s) may be sodium nitrate, phosphomolybdic acid or further boron nitrate or mixtures of the latter.

The content of this(these) compound(s) such as the "tacky" nitrate(s) and/or other "tacky" compounds in the effluent, expressed as oxides, based on the total mass of nitrates contained in the effluent, also expressed as oxides, is generally greater than 35% by mass, or greater than 30% by mass for sodium nitrate expressed as oxides.

Instead of the total mass of nitrates contained in the effluent, expressed as oxides, it would be optionally possible, more specifically, to use the total mass of salts (including the nitrates) contained in the effluent, expressed as oxides.

The method according to the invention in particular allows calcination of effluents having a high content of compounds such as nitrates and other so-called "tacky" compounds, i.e. greater than 35% by mass for the whole of the "tacky" nitrates, or greater than 30% by mass for sodium nitrate.

In a particularly advantageous way, the method according to the invention allows calcination of solutions with a high sodium content which are very tacky.

By "high content" of sodium, more specifically of sodium nitrate, is generally meant that the effluent has a sodium nitrate content, expressed as sodium oxide, based on the total mass of the nitrates (or optionally, more specifically, based on the total mass of the salts) contained in the effluent, expressed as oxides, greater than 30% by mass, preferably greater than 50% by mass.

The inequations mentioned above having been observed in the mixture formed after adding the dilution adjuvant into the effluent to be calcinated, and the clogging problems having consequently been avoided, a single calcination test allows optimization of the characteristics of the calcinate by acting on the heating of the different areas of the calciner, on the calcination adjuvant content (generally) and on the speed of rotation of the calciner tube.

The conditions of this calcination, except for the notable fact that any clogging is avoided, are not fundamentally modified by the fact that the addition of dilution adjuvant has to meet the criteria added by inequations (1) and (2).

The conditions of the calcination are generally the following: temperature reached by the calcinate of about 400° C.

This calcination step is generally carried out in a rotating tube which is heated preferably up to the intended temperature indicated above, for example by an electric oven with several independent heating areas.

Heating areas are more particularly dedicated to evaporation and others to calcination. The calcination areas allow the calcinate to be heated to a temperature of 400° C.

In other words, the calcination step is carried out at a calcinate temperature at the outlet of the oven of about 400° C.

The speed of rotation of the tube, the addition of the calcination adjuvant and the presence of a loose bar allows the solid calcinate to be split up so that the latter may react under good conditions in the vitrification unit.

The treatment method according to the invention generally comprises, after the calcination step, a step for vitrification of the calcinate obtained during this calcination step. This vitrification step consists in a reaction between the calcinate and a glass frit (preformed glass) in order to obtain a confinement glass.

In other words, after the calcination step, a vitrification step is carried out which consists of elaborating a confinement glass from the melting of the calcinate stemming from the calcination step with some glass frit.

As this was already specified above, the application preferably in the dilution adjuvant of specific iron and rare earth nitrates further advantageously allows the constraints as to the formulation of the glass to become more flexible. In particular, a higher proportion of effluent may be incorporated into the glass when the calcinate was obtained by using the dilution adjuvant according to the invention in the place and instead of a dilution adjuvant only consisting of aluminium nitrate.

In other words, the restrictive limit on the level of incorporation of effluents into the glass, due to aluminium nitrate is suppressed, and the incorporation level is significantly increased and for example passes from 13% by mass of oxides to 18% by mass of oxides based on the total mass of the glass.

Further, the significant provision of aluminium in the case of a dilution adjuvant only consisting of aluminium nitrate tends to harden the calcinate and has the consequence of causing lowering of the reactivity between the calcinate and the glass frit in the vitrification oven.

On the contrary, adding iron makes the calcinate more friable and therefore easier to vitrify.

Vitrification consists in a melting reaction between the calcinate and the glass frit in order to form a confinement, containment glass. It is carried out in two types of ovens: indirect induction ovens which consist of heating by four inductors a metal pot, can, into which is fed the frit/calcinate mixture, and direct induction ovens which consist of heating the glass by an inductor through a cooled structure (cold crucible) which lets through a portion of the electromagnetic field and into which the frit/calcinate mixture is continuously fed.

The invention will now be described with reference to the following examples, given as an illustration and not as a limitation.

EXAMPLE 1

In this example, the calcination of an effluent containing a high sodium nitrate content is described.

The composition of this effluent (waste) is given in Table 1, this composition being expressed as mass % of the oxides corresponding to the salts contained in the effluent, which are nitrates.

The percentage of the oxides is expressed on the basis of the total mass of the oxides corresponding to the salts contained in the effluent.

The effluent described in Table 1 below is highly loaded especially with sodium and therefore very tacky.

According to the invention the solution of the mixture of the effluent (of the waste) with the dilution adjuvant (whatever it may be) the two following inequations should be verified.

$$\frac{\text{mass of sodium nitrate of the mixture expressed in terms of oxide } Na_2O}{\text{mass of all the compounds of the mixture expressed in terms of oxides}} \leq 0.3 \quad (1)$$

$$\frac{\text{mass of all the compounds of the mixture leading upon their calcination to tacky oxides, expressed in terms of oxides}}{\text{mass of all the compounds of the mixture expressed in terms of oxides}} \leq 0.35 \quad (2)$$

or more simply $$\frac{\text{mass of } Na_2O}{\text{mass of all the oxides of the mixture}} \leq 0.3 \quad (1)$$

$$\frac{\text{mass of the tacky oxides}}{\text{mass of all the oxides of the mixture}} \leq 0.35 \quad (2)$$

The application of the calcination criterion to the particular effluent described in Table 1 is expressed by:

$$\frac{\text{mass of } Na_2O}{\text{mass of all the oxides of the mixture}} \leq 0.3 \quad (1)$$

and $$\frac{\text{sum of the masses of } Na_2O, MoO_3 \text{ and } B_2O_3}{\text{mass of all the oxides of the mixture}} \leq 0.35 \quad (2)$$

Indeed, the man skilled in the art easily identifies tacky oxides (or more specifically tacky oxides which are generated by the calcination of the nitrates or of the other compounds found in the effluent) of this effluent which are $Na_2O$, $MoO_3$ and $B_2O_3$.

For this effluent, it is the second inequation which is the most restrictive.

If the limit of the domain defined by the inequation (2) is examined, the proportion of liquid effluent (solution) expressed as oxides, in the liquid effluent mixture will be at most 51.27% by mass and this regardless of the adjuvant used. Indeed, in inequation (2) gives for this effluent:

$$\frac{56.43 + 5.71 + 6.13}{100 + x} \leq 0.35$$

x representing the mass of added dilution adjuvant expressed as oxide i.e.:

$68.27 \leq 35 + 0.35x$, and therefore $x \geq 95.05$

It follows that the maximum proportion of liquid effluent (solution) in the mixture will therefore be:

$$\frac{100}{95.05 + 100} = 0.5127 \text{ i.e. } 51.27\%.$$

Accordingly, taking into account the above calculation, to the effluent of Table 1 is added an adjuvant (adjuvant 1) which consists of 100% by mass of aluminium nitrate expressed as oxide $Al_2O_3$, in an amount of 95.05% by mass of adjuvant expressed as oxide for 100% by mass of effluent expressed as a mass % of the oxides corresponding to the salts contained in the effluent. It should be noted that the amount of adjuvant was minimized by applying the criteria according to the invention.

The conditions of the calcination are the following:

Calciner with four independent heating areas, the temperature reached by the calcinate is about 400° C., the speed of rotation of the rotating tube containing the loose bar is 20 rpm, the amount of calcination adjuvant is 40 g/L of the mixture of the effluent with the dilution adjuvant.

No adhesion on the walls and no clogging of the calciner are observed.

EXAMPLE 2

In this example, calcination is carried out on the same effluent as the one of Example 1 and described in Table 1.

To this effluent a preferred adjuvant (adjuvant 2) according to the invention is added, which consists of 75% by mass of aluminium nitrate expressed as oxide $Al_2O_3$ and of 25% by mass of iron nitrate expressed as oxide $Fe_2O_3$. This adjuvant is added in a same amount as the adjuvant 1 determined by the same calculations on the basis of the criteria according to the invention.

Thus 95.05% by mass of adjuvant expressed as oxide for 100% by mass of effluent (waste) expressed as a mass % of the oxides corresponding to the salts contained in the effluent, are added.

The conditions of the calcination are the same as those of Example 1.

No adhesion on the walls and no clogging of the calciner are observed.

TABLE 1

| Compound | Waste (mass %) | Adjuvant 1 (mass %) | Adjuvant 2 (mass %) |
|---|---|---|---|
| $Al_2O_3$ | | 100.00 | 75.00 |
| BaO | 2.98 | | |
| $Na_2O$ | 56.43 | | |
| $Cr_2O_3$ | 0.56 | | |
| NiO | 0.48 | | |
| $Fe_2O_3$ | 1.63 | | 25.00 |
| $MnO_2$ | 1.61 | | |
| $La_2O_3$ | 0.44 | | |
| $Nd_2O_3$ | 3.45 | | |
| $Ce_2O_3$ | 6.24 | | |
| $ZrO_2$ | 8.23 | | |
| $MoO_3$ | 5.71 | | |
| $P_2O_5$ | 3.49 | | |
| $RuO_2$ | 1.00 | | |
| $B_2O_3$ | 6.13 | | |
| $SO_3$ | 1.61 | | |
| | 100.00 | | |

EXAMPLE 3

In this example, it is proceeded with the vitrification of the calcinate obtained in Example 1. Let us recall that this calcinate was prepared by using an adjuvant ("adjuvant No. 1") exclusively consisting of aluminium nitrate.

The glass composition domain which we were able to elaborate imposes a maximum alumina content of 13% by mass in the glass.

The glass is elaborated from the calcinate and from a glass frit containing 1% by mass of alumina Vitrification was carried out in a cold crucible at 1,230° C.

EXAMPLE 4

In this example, it is proceeded with the vitrification of the calcinate obtained in Example 2. Let us recall that this calcinate was prepared by using a preferred adjuvant ("adjuvant No. 2") consisting of 75% by mass of aluminium salt and of 25% by mass of iron salt.

It was determined that the maximum incorporation level of the initial waste (therefore before mixing) is limited to 12.9% by mass of the glass in Example 3 while in the present Example 4, the maximum incorporation level is 17.3%.

Further, the significant provision of aluminium by the adjuvant No. 1 tends to harden the calcinate and has the consequence of causing a slight lowering of reactivity between the calcinate and the glass frit in the vitrification oven.

On the other hand, provision of iron with the adjuvant No. 2, according to the invention, makes the calcinate more friable and therefore easier to vitrify.

EXAMPLE 5

In this example, the calcination of an effluent consisting of 100% of sodium nitrate as described in Table 2, is described.

According to a first experiment, an adjuvant, (adjuvant 1) of the prior art which consists of 100% by mass of aluminium nitrate expressed as oxide $Al_2O_3$ is added to this effluent.

According to a second experiment, calcination of the sodium nitrate is carried out with an adjuvant (adjuvant 3) according to the invention in which part of the aluminium nitrate is replaced with lanthanum, cerium, neodymium and praseodymium nitrates.

For both cases, the dilution adjuvant content is given by the inequation (1) which leads to:

$$\frac{100}{100+x} \leq 0.30$$

x representing the added dilution adjuvant mass expressed as oxide i.e.:

$100 \leq 30+0.3x$, and therefore $x \geq 233.33$

The minimum dilution adjuvant content to be added to this effluent exclusively consisting of sodium nitrate expressed as a mass of total oxide represents 70% in the mixture of the effluent with the dilution adjuvant.

The calcination conditions are the following:

Calciner with two independent heating areas, the temperature reached by the calcinate is about 400° C., the speed of rotation of the rotating tube containing the loose bar is 35 rpm, the calcination adjuvant content is 20 g/L of the mixture of the effluent with the dilution adjuvant.

TABLE 2

| | Effluent (%) | Adjuvant 1 (%) | Adjuvant 3 (%) |
|---|---|---|---|
| $Na_2O$ | 100 | | |
| $Al_2O_3$ | | 100 | 38.05 |
| $La_2O_3$ | | | 8.65 |
| $Nd_2O_3$ | | | 28.56 |
| $Ce_2O_3$ | | | 16.78 |
| $Pr_2O_3$ | | | 7.95 |

The invention claimed is:

1. A method for treating a nitric aqueous liquid effluent containing nitrates of metals or metalloids, comprising the steps of:

adding a dilution adjuvant to the effluent; and a step for calcination of the effluent in order to convert the nitrates of metals or metalloids into oxides of said metals or metalloids, at least one compound selected from the nitrates of metals or metalloids and the other compounds of the effluent leading upon calcination to a tacky oxide, wherein the dilution adjuvant comprises at least one nitrate of metal or metalloid leading upon calcination to a non-tacky oxide, the dilution adjuvant being added to the effluent prior to the calcination step in order to give a mixture of effluent and dilution adjuvant, in which the mixture meets the two following inequations (1) (2):

$$\frac{\text{mass of sodium nitrate of the mixture expressed in terms of oxide } Na_2O}{\text{mass of all the compounds of the mixture expressed in terms of oxides}} \leq 0.3 \quad (1)$$

$$\frac{\text{mass of all the compounds of the mixture leading upon their calcination to tacky oxides, expressed in terms of oxides}}{\text{mass of all the compounds of the mixture expressed in terms of oxides}} \leq 0.35. \quad (2)$$

2. The method according to claim 1, wherein the dilution adjuvant comprises aluminium nitrate and optionally at least one other nitrate selected from iron nitrate and rare earth nitrates.

3. The method according to claim 2, wherein the dilution adjuvant comprises aluminium nitrate and optionally at least one other nitrate selected from iron nitrate, lanthanum nitrate, cerium nitrate, praseodymium nitrate and neodymium nitrate.

4. The method according to claim 1, wherein said at least one compound leading upon calcination to one or more tacky oxide(s), is (are) selected from sodium nitrate, phosphomolybdic acid, boron nitrate and mixtures thereof.

5. The method according to claim 1, wherein the content of nitrate(s) and of other compound(s) leading upon calcination to a tacky oxide, expressed as oxide, based on the total mass of the salts contained in the effluent, expressed as oxide, is greater than 35% by mass.

6. The method according to claim 5, wherein the effluent has a sodium nitrate content expressed as sodium oxide $Na_2O$, based on the total mass of the salts contained in the effluent, expressed as oxide, greater than 30% by mass.

7. The method according to claim 1, wherein the calcination step is carried out at a temperature leading to a calcinate temperature at the outlet of an oven of about 400° C.

8. The method according to claim 1, wherein the calcination is carried out in a heated rotating tube.

9. The method according to claim 1, wherein after the calcination step, a vitrification step is carried out wherein the calcinate from the calcination step is melted with a glass frit whereby a confinement, containment glass is obtained.

10. The method according to claim 1, wherein the dilution adjuvant consists essentially of at least one nitrate of metal or metalloid leading upon calcination to a non-tacky oxide.

* * * * *